US005301613A

United States Patent [19]

Muirhead

[11] Patent Number: 5,301,613

[45] Date of Patent: Apr. 12, 1994

[54] POWER SUPPLY FOR AN ELECTRICAL CIRCUIT MOUNTED ON A PROJECTILE

[75] Inventor: James O. Muirhead, San Pedro, Calif.

[73] Assignee: Hughes Aircraft Company, Los Angeles, Calif.

[21] Appl. No.: 944,633

[22] Filed: Sep. 14, 1992

[51] Int. Cl.[5] ..... F42C 11/02

[52] U.S. Cl. ..... 102/210; 102/216; 102/218; 310/334

[58] Field of Search ..... 102/210, 207, 216, 218, 102/220; 310/322, 334, 329

[56] References Cited

U.S. PATENT DOCUMENTS

| | | | |
|---|---|---|---|
| 3,323,459 | 6/1967 | Buffet | 102/207 |
| 3,359,904 | 12/1967 | Nerheim | 102/210 |
| 3,902,172 | 8/1975 | Weiss et al. | 102/213 |
| 3,922,968 | 12/1975 | Conger et al. | 102/207 |
| 4,387,649 | 6/1983 | Weidner et al. | 102/216 |
| 5,157,220 | 10/1992 | Schaffhauser et al. | 102/210 |

FOREIGN PATENT DOCUMENTS

| | | | |
|---|---|---|---|
| 1145522 | 3/1963 | Fed. Rep. of Germany | 102/210 |
| 1312121 | 11/1962 | France | 102/216 |

*Primary Examiner*—Stephen M. Johnson

*Attorney, Agent, or Firm*—Wanda K. Denson-Low

[57] ABSTRACT

An improved power supply (10) for an electrical circuit (12) mounted on a projectile. The inventive power supply (10) includes a mechanism (14) on the projectile for generating electrical energy on the acceleration thereof. The energy is stored and released to a load on the deceleration of the projectile. In a particular implementation, the energy producing mechanism (14) is a piezo-electric transducer. Storage of electrical energy in the transducer is facilitated by the connection of a diode (16) across the output terminals thereof. An acceleration switch (18) is provided which is mounted on the projectile to be open on acceleration and closed on deceleration thereof. The switch (18) thereby releases a predetermined amount of stored energy to the load (12) only on the impact of the projectile with an object.

3 Claims, 1 Drawing Sheet

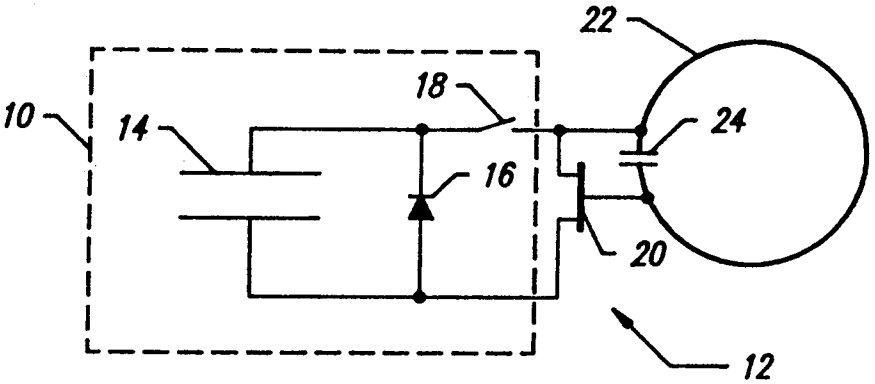
FIG. 1
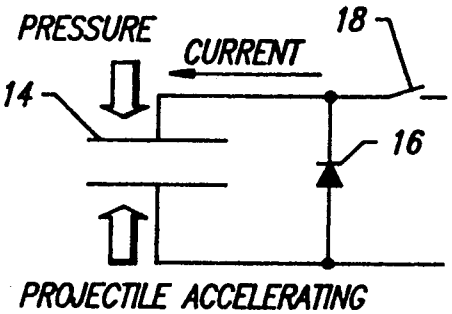
FIG. 2a
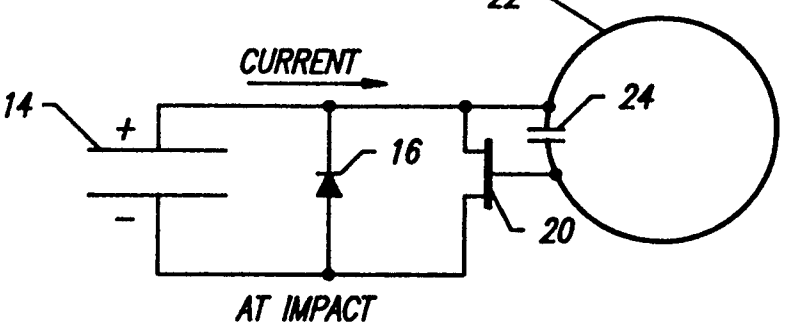
FIG. 2b
FIG. 2c

POWER SUPPLY FOR AN ELECTRICAL CIRCUIT MOUNTED ON A PROJECTILE

BACKGROUND OF THE INVENTION

1. Field of the Invention

The present invention relates to communication systems. More specifically, the present invention relates to inexpensive, expendable power supplies for low power radio frequency transmitters.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

In many applications, there is a need for an inexpensive power supply for a low power radio frequency transmitter. For example, in military applications, the conventional technique for determining the ability of a gunner to hit a target with a projectile is visual. That is, the target is simply visually examined to determine the number of hits and, hence, the score of the gunner.

Unfortunately, the visual scoring method is costly due to the requirement that the target be retrieved and examined to provide a score. Visual scoring from a remote location is often complicated by numerous range and/or battlefield conditions including darkness, haze, smoke, dust, and etc. In addition, there is no real time feedback of a gunners score during the firing operation. Accordingly, the opportunity for real time correction is not provided with conventional scoring techniques.

U.S. patent application entitled RADIO FREQUENCY DEVICE, FOR MARKING MUNITION IMPACT POINT, Ser. No. 07/798,480, filed Nov. 26, 1991, by J. O. Muirhead and G. E. Held discloses a unique and advantageous automatic system for gunnery scoring. The system includes a plurality of miniature radio transmitters which are mounted on one or more of the projectiles. The transmitters are energized when the projectile impacts the target. The transmitted signal is detected by one or more receivers. Detection occurs when the received signal exceeds a fixed threshold. By accurately monitoring the time of arrival at a number of different locations, the angle of arrival may be determined at each receiver from which the impact point of the round can be determined by triangulation.

When widely separated receivers are used, the difference between the times of arrival of the radio frequency (RF) energy at any pair or receivers defines a hyperbolic line of position which is the locus of all points which have that difference in distance from the pair of receivers. The use of three (or more) receivers will define three (or more) lines of position. Where these lines intersect is the origin of the RF energy in the plane of the system.

When closely spaced receivers are used, the difference between times of arrival between the receivers and the distance between the receivers define the direction from which the energy arrived at the pair. With two or more pairs of receivers at known locations distant from the impact area, the location of the origin of the RF energy can be determined. The use of wide beam, directional antennas eliminates ambiguity in location of the RF emission source.

In any event, since the energy for the transmitter is generated by the impact of the projectile with the target, the amount of electrical energy available to the transmitter oscillator varies in accordance with the hardness of impact points for different objects and the angle at which the projectile strikes the object. This produces differing decelerations and therefore differing amounts of electrical current into the transmitter oscillator. The amount of energy into the transmitter determines the amount of energy radiated by the transmitter. Accordingly, the energy of the signals radiated by the transmitters of this system varies considerably from round to round. This complicates detection and scoring.

Thus, a need remains for an improved power supply for radio frequency (RF) projectiles which provides a consistent amount of radiated power on impact with soft as well as hard objects.

SUMMARY OF THE INVENTION

The need in the art is addressed by the present invention which provides an improved power supply for an electrical circuit mounted on a projectile. The inventive power supply includes a mechanism on the projectile for generating electrical energy on the acceleration thereof. The energy is stored and released to the load on the deceleration of the projectile.

In a particular implementation, the energy producing mechanism is a piezo-electric transducer. Storage of electrical energy in the transducer is facilitated by the connection of a diode across the output terminals thereof. An acceleration switch is provided which is mounted on the projectile to be open on acceleration and closed on deceleration thereof. The switch thereby releases a predetermined amount of stored energy to the load only on the impact of the projectile with an object.

BRIEF DESCRIPTION OF THE DRAWINGS

FIG. 1 is a schematic diagram of the improved power supply of the present invention connected to an illustrative transmitter circuit.

FIG. 2*a* is a schematic diagram of the improved power supply of the present invention simplified to illustrate the operation thereof when the projectile is accelerating.

FIG. 2*b* is a schematic diagram of the improved power supply of the present invention simplified to illustrate the operation thereof after the projectile has experienced acceleration.

FIG. 2*c* is a schematic diagram of the improved power supply of the present invention simplified to illustrate the operation thereof when the projectile is decelerating on impact.

DESCRIPTION OF THE INVENTION

Illustrative embodiments and exemplary applications will now be described with reference to the accompanying drawings to disclose the advantageous teachings of the present invention.

As mentioned above, U.S. patent application entitled RADIO FREQUENCY DEVICE FOR MARKING MUNITION IMPACT POINT, Ser. No. 07/798,480, filed Nov. 26, 1991, by J. O. Muirhead and G. E. Held, the teachings of which are incorporated herein by reference, discloses a unique and advantageous automatic system for gunnery scoring. The system includes a plurality of miniature radio transmitters which are mounted on one or more of the projectiles. The transmitters are energized when the projectile impacts the target. The transmitted signal is detected by one or more receivers. Detection occurs when the received signal exceeds a fixed threshold. By accurately monitoring the time of arrival at a number of different locations, the angle of arrival may be determined at each receiver from which the impact point of the round can be determined by triangulation.

Since the energy for the transmitter is generated by the impact of the projectile with the target, the amount of electrical energy available to the transmitter oscillator varies due to differing hardness of impact points for different objects and the angle at which the projectile strikes the object. This produces differing decelerations and therefore differing amounts of electrical current into the transmitter oscillator. The amount of energy into the transmitter determines the amount of energy radiated by the transmitter. Accordingly, the energy of the signal radiated by the above-described transmitter varies considerably as a function of the hardness of the object. This complicates detection and scoring.

Thus, there remains a need for an improved power supply for radio frequency (RF) projectiles which provides a consistent amount of radiated power on impact with soft as well as hard objects.

The need is addressed by the present invention which provides a power supply for RF projectiles which supplies a predetermined amount of power to the transmitter on the deceleration of the projectile independent of the angle of impact or the hardness of the target.

FIG. 1 is a schematic diagram of the improved power supply of the present invention 10 connected to an illustrative transmitter load 12. The improved power supply 10 is mounted on a projectile (not shown) which is fired from a gun. The improved power supply includes a piezo-electric transducer 14 having two output terminals across which a diode 16 is connected. The piezo-electric transducer 14 is designed to withstand the forces associated with the firing of the projectile. In addition, the piezo-electric material must, on acceleration of the projectile, provide the power necessary for the transmitter and hold it until impact as discussed more fully below.

In accordance with conventional design techniques, the piezo-electric transducer 14 is designed to meet the geometric requirements of the projectile while providing an area and cross-section sufficient to produce the necessary power when the projectile is accelerated by the pressure in the chamber of the firing mechanism. The mass of the projectile is incorporated into the design in a conventional manner. Exemplary piezo-electric materials suitable for this purpose include ceramics such as barium titanate and lead zironate titanate. Other materials that exhibit piezo-electricity include quartz and Kynar plastic.

The diode 16 is connected across the terminals of the piezo-electric transducer 14 as shown. The acceleration switch 18 is connected between the piezo-electric transducer 14 and the transmitter load 12. The acceleration switch or "g" switch is an inertial switch designed conventionally to remain open when the projectile is accelerated or is undergoing mild deceleration such as that caused by aerodynamic drag forces in flight. In the best mode, the "g" switch is constructed on the device during the manufacturing process as an integral part of the device. The switch must be designed such that it will remain open until a predetermined amount of deceleration is experienced by the projectile and imparted to the switch 18 such as that provided on impact with wood or other soft targets.

The illustrative transmitter load 12 is shown in FIG. 1 as including a transmitter circuit denoted generally as a transistor 20 and an antenna band 22. The antenna band 22 extends around the periphery of the projectile (not shown). Those skilled in the art will appreciated that the improved power supply of the present invention may be used in connection with other loads without departing from the scope of the present teachings.

FIG. **2*a* is a schematic diagram of the improved power supply of the present invention simplified to illustrate the operation thereof when the projectile is accelerating. As depicted in FIG. 2*a*, on the firing of the projectile, the material of the piezo-electric transducer 14 is compressed by the gasses in the barrel chamber resulting in an electrical potential thereacross. This potential causes a current to flow through the diode, short circuiting the power supply. While compressed, the current flows from the bottom of the piezo-electric transducer 14 through the diode 16 to the top of the piezo-electric transducer 14**. This charges a capacitance formed by the electrical connection and the body of the piezo-electric transducer. Piezo-electric materials are insulators. In addition, many exhibit strong ferro-electricity resulting in very high dielectric coefficients in the presence of an electric field. The dielectric coefficient of barium titanate ($BaTiO_3$), for example, is approximately 10,000 at 120° C. The greater the dielectric coefficient, the more capacitance is available for a given geometry. The ferro-electric effect causes the dielectric coefficient to increase rapidly with temperature above a transition temperature known as the Curie point.

When the projectile exits the muzzle of the weapon, the pressure on the power supply 10 is released and current attempts to flow in a reverse direction through the diode 16. As the diode 16 prevents this reverse current flow, a net potential voltage remains across the transducer 14 as shown in FIG. **2*b*. FIG. 2*b*** is a schematic diagram of the improved power supply of the present invention simplified to illustrate the operation thereof after the projectile has experienced acceleration.

The acceleration switch 18 is open on launch and during projectile flight ensuring that the charge remains across the piezo-electric transducer 14 and hence across the power supply 10. When the projectile strikes an object, the acceleration switch 18 closes applying power to the transmitter oscillator which then radiates RF energy into the air as shown in FIG. **2*c*. FIG. 2*c*** is a schematic diagram of the improved power supply of the present invention simplified to illustrate the operation thereof when the projectile is decelerating on impact.

As the piezo-electric power supplies are subjected to the same pressure for the same time duration, each time a projectile is fired, the same amount of voltage and current are delivered to the transmitters with the closing of the associated acceleration switch on impact.

Thus, the present invention has been described herein with reference to a particular embodiment for a particular application. Those having ordinary skill in the art and access to the present teachings will recognize additional modifications applications and embodiments within the scope thereof.

It is therefore intended by the appended claims to cover any and all such applications, modifications and embodiments within the scope of the present invention.

Accordingly, what is claimed is:

1. An improved power supply for an electrical circuit mounted on a projectile having a radio frequency transmitter, said projectile being accelerated upon firing and decelerated upon impact, said improved power supply comprising:

a single piezo-electric transducer mounted on said projectile for generating a predetermined amount of electrical energy on said acceleration thereof, said transducer having positive and negative output terminals, said transducer having a cross-sectional area and depth sufficient to produce power for said transmitter, said piezo-electric transducer being formed of a piezo-electric material having a dielectric coefficient sufficient to provide capacitive storage in the presence of an electric field.

a diode mounted across said positive and negative output terminals of said piezo-electric transducer for causing said transducer to store said electrical energy generated thereby; and an acceleration switch connected between said transducer and said transmitter, said switch being open on said acceleration of said projectile and closed on said deceleration of said projectile thereby applying said predetermined amount of energy stored in said transducer to said transmitter, said acceleration switch and transducer and diode being integrated together on said projectile.

2. An improved power supply for an RF transmitter, said power supply being coupled to the RF transmitter and being mounted on a projectile, said projectile being accelerated upon firing and decelerated upon impact, said power supply providing a consistent amount of power to said RF transmitter on impact, comprising:

a single piezo-electric transducer having two output terminals, said transducer having a cross-sectional area and depth sufficient to produce electrical energy for the RF transmitter on said acceleration of said projectile;

said piezo-electric transducer being formed of a piezo-electric material having a dielectric coefficient sufficient to provide capacitive storage in the presence of an electric field;

said transducer and said output terminals forming a capacitor for storing electrical energy;

a diode connected across the output terminals of said piezo-electric transducer for causing said transducer to store said electrical energy generated thereby; and an acceleration switch connected between said transducer and said transmitter, said acceleration switch being in an open position on said acceleration of said projectile and in a closed position on said deceleration of said projectile.

3. The power supply of claim 2 wherein said acceleration switch is integrated into said projectile.

* * * * *